United States Patent [19]

Butzke et al.

[11] 4,255,164

[45] Mar. 10, 1981

[54] FINING SHEET AND METHOD OF MAKING AND USING THE SAME

[75] Inventors: Hilbert C. Butzke, North Hudson, Wis.; Dennis W. Harry, Mahtomedi, Minn.

[73] Assignee: Minnesota Mining and Manufacturing Company, Saint Paul, Minn.

[21] Appl. No.: 33,867

[22] Filed: Apr. 30, 1979

Related U.S. Application Data

[63] Continuation-in-part of Ser. No. 980,926, May 24, 1978, abandoned.

[51] Int. Cl.[3] ..... B24D 11/02; B24B 1/00

[52] U.S. Cl. ..... 51/295; 51/284 R; 51/297; 51/298; 51/395; 51/405; 51/406; 51/407

[58] Field of Search ..... 51/293, 295, 297, 298, 51/284 R, 395, 402, 405, 406, 407

[56] References Cited

U.S. PATENT DOCUMENTS

| | | | |
|---|---|---|---|
| 2,667,436 | 1/1954 | Goepfert et al. | 51/297 |
| 3,042,509 | 7/1962 | Soderburg | 51/305 |
| 3,044,891 | 7/1962 | Lauchenauer et al. | 51/298 |
| 3,144,737 | 8/1964 | Faas | 51/406 |
| 3,260,582 | 7/1966 | Zimmer et al. | 51/293 |
| 3,921,344 | 11/1975 | Goodwin | 51/297 |
| 3,959,935 | 6/1976 | Stoppacher | 51/407 |
| 4,035,961 | 7/1977 | Pemrick et al. | 51/295 |
| 4,084,941 | 4/1978 | Cox et al. | 51/298 |
| 4,086,068 | 4/1978 | Hedin | 51/297 |

FOREIGN PATENT DOCUMENTS

| | | | |
|---|---|---|---|
| 1161885 | 8/1969 | United Kingdom | 51/298 |
| 1259006 | 1/1972 | United Kingdom | 51/298 |

*Primary Examiner*—Donald J. Arnold

*Attorney, Agent, or Firm*—Cruzan Alexander; Donald M. Sell; Richard Francis

[57] ABSTRACT

A glass fining sheet particularly suited for finishing rough ground vitreous surfaces to provide a surface finish which may be readily polished comprises a flexible, conformable backing sheet bearing a microcellular abrasive granule-resin matrix which, under use conditions and in the presence of an aqueous flow, generates a fining slurry. The fining sheet according to this invention is prepared by coating a flexible conformable backing sheet with a foamed liquid abrasive granule-resin coating composition comprised of liquid curable binder material, abrasive fining granules and sufficient compatible solvent to provide a coatable composition. Such coating provides a cellular layer which releases the fining abrasive granules at a controlled rate under use conditions.

6 Claims, 3 Drawing Figures

FINING SHEET AND METHOD OF MAKING AND USING THE SAME

CROSS REFERENCE TO RELATED APPLICATION

This is a continuation-in-part of copending application Ser. No. 908,926, filed May 24, 1978 now abandoned.

BACKGROUND OF THE INVENTION

1. Field of the Invention

This invention relates to finishing the surface of vitreous materials. In particular, this invention relates to an abrasive fining sheet, its method of production and its method of use.

2. Description of the Prior Art

The grinding and polishing of glass surfaces are important processes in producing acceptable surfaces on optical components, such as lenses, prisms, mirrors, and the like. Such processes are also useful for repairing scratched or otherwise damaged surfaces of utility glass, such as plate glass windows, windshields of automobiles, windows in railroad cars, display cases, and observation windows of instruments and various other types of equipment. And, while glass may be the primary material which is ground and polished, the processes discussed herein also relate to the grinding and polishing of other vitreous materials such as gem stones and the like. Any discussions hereinafter with respect to finishing glass per se are also intended to relate to such other materials, if applicable.

The production of a smooth, finished vitreous surface involves three basic operations. The first operation involves rough grinding of the surface being finished with a coarse hard abrasive such as diamond to produce the desired configuration, for example, either a flat surface or the proper degree of curvature in the case of a lens. The next step, called "fining", involves a preliminary finishing of the coarse ground surface to remove deep scratches, correct elliptical error in the case of glass lenses, and otherwise provide a substantially smooth although not polished surface. The last step, called the polishing step, involves fine grinding to remove small scratches and provide a smooth, finished, or, in the case of an optical component, an optically clear surface. This invention is concerned only with the fining step or operation.

Prior to the present invention, it was conventional to employ a slurry of the appropriate abrasive particles in a liquid vehicle such as water in the fining operation. It has been generally known, for example, as discussed by L. Holland, *The Properties of Glass Surfaces*, John Wiley & Sons, New York, N.Y., 1964, that the loose abrasive grains of an abrasive fining slurry will, then combined under a load at the grinding interface, roll or rotate to "pit" or cut small portions out of the surface being fined to form small craters of well defined conchoidal shape and size. Blocky abrasive granules are therefore employed for this purpose to obtain a more uniform pattern of pits.

Such fining slurries are applied, for example, at the interface between the lens being finished and the curved metal lap being employed while at least one or both of these are oscillated or rotated in force contact with one another to produce a grinding action on the surface of the lens. This action not only abrades or fines the glass lens but also wears away the surface of the curved metal lap, requiring resurfacing after only a few lenses have been processed. Nonabrasive protective lap covers have been employed to retard such unwanted wear but their use increases the lens' processing time.

There are many disadvantages in grinding glass surfaces with an abrasive slurry. These include the inconvenience of handling the required large volume of the slurry, the required agitation to prevent settling of the abrasive granules and to assure a uniform concentration of abrasive granules at the grinding interface, and the need for additional equipment to prepare, to handle and also to recover and recycle the abrasive slurry. Additionally, the slurry itself must be analysed to assure its quality and dispersion stability requiring additional costly man hours. Furthermore, pump heads, valves, feed lines, grinding laps, and other parts of the slurry supply equipment which contact the slurry show undesirable abrasive wear.

Understandably, attempts have been made, generally without success, to use coated abrasive pads and belts and bonded abrasive wheels to replace slurry fining systems because of the obvious simplicity of use of such abrasive elements. However, the fixed abrasive granules of such abrasive elements do not rotate and thus do not provide the necessary pattern of pits required in the fining step. Abrasive fining slurries commonly used prior to this invention remove more glass per unit time than fining with abrasive elements which have fixed abrasive granules. Slurries also produce a more uniformly pitted surface free of scratches, and, equally important, do not create chatter marks or hairline cracks (stress crack lines which often extend deep into the bulk of the surface being fined) which are almost unavoidable when grinding with bonded or coated abrasives. Such stress cracks are generally not easily detected unless etching solutions are applied because stress cracks may be polished over to form an apparently perfect polished surface but thereafter remain as sub-surface flaws. Such flaws provide sites where cracks may easily be initiated and propagated in the event of external or internal stresses, such as caused by loads, vibrations, heat and by other sources. In a number of ground glass products, in particular safety eyeglasses, safety shields and windows, and the like, where impact resistance is of prime importance, sub-surface flaws are particularly detrimental.

The peaks of such fixed abrasive granules wear away quickly, leaving wear-flats which not only drastically reduce the amount of stock removed but also burnish and scratch the surface. The sub-surface flaws discussed above are often the result of the scratching of the glass by these wear-flats. Polishing such a surface leaves a weakened sub-surface containing numerous flaws, as explained above, resulting in unacceptable impact resistance.

While diamond abrasive granules contained in bonded abrasive sheets or wheel under higher loads may remove an amount of stock comparable to that removed by slurry grinding, the flawed sub-surface would still result since the fixed granule mechanism of stock removal is based on cutting the surface and not on the formation of desired conchoidal pits. Moreover diamond coated abrasive tools are very costly and therefore not economically practical for many applications.

Several means of incorporating fining abrasive material into a cohesive layer which will release the abrasive in use have been attempted for glass grinding operations without much success. Such attempts were directed to cause the binder material to disintegrate, dissolve or soften, and thereby free the abrasive granules which may then roll and rotate to generate the desired pitted surface in substantially the same manner as obtained in slurry fining processes. For example, it has been known to employ for this purpose lubricants such as stearic acid, tallow, paraffin wax and similar materials as a bonding agent and lubricant. Such materials generally disintegrate too rapidly because they have poor dimensional stability under the load and friction forces encountered and the generally uncontrolled frictionally generated heat.

U.S. Pat. No. 3,042,509 discloses using a water-soluble binder composition such as a mixture containing polyethylene glycol, but such a composition also disintegrates too rapidly in an uncontrollable fashion under use conditions.

SUMMARY OF THE PRESENT INVENTION

The present invention provides a fining sheet or pad which is particularly suited for finishing rough ground vitreous surfaces and for repairing scratched vitreous surfaces to provide a uniformly pitted surface better than or comparable to that provided by slurry fining, which surface may thereafter be readily polished in a subsequent polishing operation. The abrasive fining sheet of the present invention eliminates liquid handling steps and measuring and analytical operations normally associated with the use of conventional fining slurries.

A small amount of water supplied to the fining sheet of the invention permits the sheet or pad of the invention to create its own slurry in situ during the fining operation, while allowing the user to start with a clean, easily handled dry sheet or pad. The sheet of the invention includes a coating which constitutes a dry slurry concentrate which will be gradually dispersed under use conditions to form an effective mineral slurry capable of fining glass surfaces at least as well as conventional fining slurries.

The abrasive fining sheet according to the present invention is particularly suited for finishing rough ground glass lenses when employed with conventional glass lens fining or polishing machines. The undesirable abrasion of feed lines, valves, pump heads, and other equipment, usually associated with the use of conventional abrasive fining slurries, is eliminated. The fining sheet of the invention also protects the texture and curvature of the lap surface, virtually eliminating resurfacing operations normally associated with the use of conventional slurries.

The abrasive fining sheet of the invention comprises a microcellular layer formed of water-insoluble modified phenol formaldehyde or urea formaldehyde resinous binding material which bonds therein fining abrasive granules on a flexible conformable backing sheet. The abrasive sheet of the present invention is made by coating the backing sheet with a composition comprising liquid binder, fining abrasive granules and sufficient compatible solvent, if needed, to provide a foamed, homogeneous, coatable composition. The coating composition is prepared, coated, dried and cured to yield a uniform microcellular, handlable, somewhat brittle coating which will erode or disintegrate and release its loading of fining abrasive granules at a uniform controlled rate under use conditions. The gradually released abrasive granules are capable of rotating freely and thereby generate a uniformly pitted surface, leaving as flawless a sub-surface as conventional fining slurries as may be verified by etching the subsequently polished surface.

Specifically, the fining sheet of the present invention comprises a flexible, conformable backing sheet covered on one side thereof with a microcellular, abrasive-containing, resinous layer having a weight of at least 450 grams per $m^2$, a thickness of at least 10 mils, and the capability of being uniformly eroded in use. The resinous binder material is a thermosetting polymer which is selected from the group consisting of urea formaldehyde and phenol formaldehyde and which is modified by the addition of about 1% to about 40% (preferably 3% to 15%) by weight of a thermoplastic polymeric modifier. The thermoplastic modifier may be selected from the group consisting of polyamide, polyacrylate, polyacrylonitrile, polyvinyl ester, polyvinyl alcohol, copolymers comprising such thermoplastic polymeric materials and combinations thereof. The abrasive fining granules have a Knoop hardness of at least about 1000 and an average particle size of about 15 to 60 microns and are contained in the microcellular layer to provide a volume ratio of abrasive granules to binder in the range of about 0.75:1 to 1.75:1.

The rate of abrasive granule release under use conditions is controllable because release of the abrasive granules does not depend on binder solubility parameters as in the prior art. Rather, granule release from the pad of the invention depends upon the gradual mechanically induced failure of the coating. The coating binder is a fragile microcellular matrix containing fining granules throughout, which, under load and frictional surface contact in the presence of an aqueous flow, readily releases its surface abrasive granules at a useful rate for effective fining without undesirable clustering or agglomeration.

The manner in which the microcellular layer erodes, disintegrates or wears away is a critical factor in determining whether or not it will complete the fining operation in a satisfactory and in a commercially acceptable period of time. For commercial purposes, it is highly desirable for one fining sheet to be employed to complete an entire fining operation. The fining sheet should erode at a sufficiently rapid rate to provide the necessary concentration of abrasive granules at the interface with the stock being fined, yet the sheet should not wear away so fast as to exhaust its supply of abrasive before the fining operation is completed. The rate at which the sheet or pad of the invention erodes or wears away may be determined by an erodability test which is a measure of the average volume of product coating lost during a controlled simulated use test. The test involves abrading a weighed 11.4 cm diameter disc of the sheet being tested in a standard Taber abrader. The coating is wetted with water and two 5 cm diameter, 1.3 cm wide standard type H-22 "Calibrade" abrasive wheels are mounted each under a load of 1000 gram against the coating surface of the test pad, and the disc rotated for 100 revolutions with the addition of small amounts of water at the surface of the test disc. The test disc is then removed, the loose abraded coating washed away, and the disc is dried and weighed. The coating volume lost, referred to hereinafter as the "erodability index", is obtained by dividing weight lost by the specific density of the coating. It has been observed that useful fining sheets according to the present invention have an erodability index between about 0.15 to about 0.30 $cm^3$.

When used, the sheet of the invention may be interposed between a lap or other pad holding device and a vitreous surface being fined while applying conventional motion and pressure with a sufficient aqueous flow to generate a fining slurry and remove surface stock.

DESCRIPTION OF THE PREFERRED EMBODIMENTS

Figure 1:
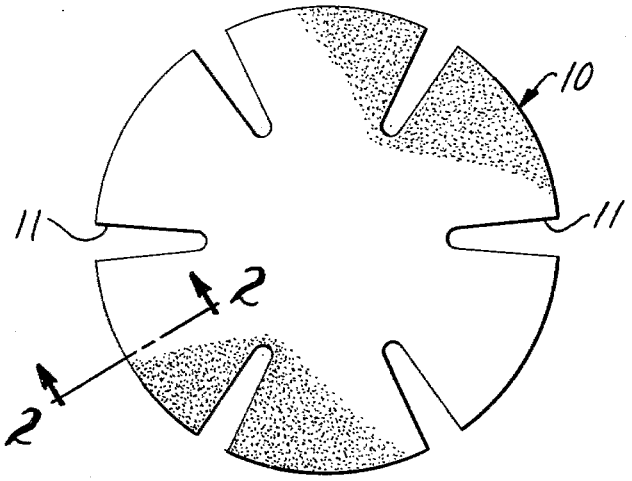
FIG. 1 is a plan view of the glass fining sheet illustrative of the present invention made in the form of a slotted disc suited for use in a conventional lens fining apparatus.
Figure 2:
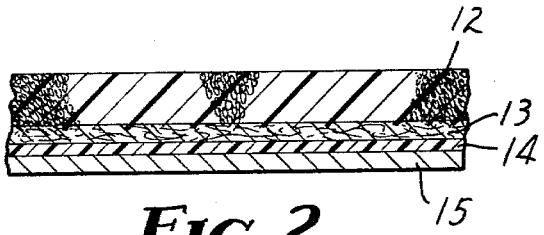
FIG. 2 is a fragmentary cross-sectional view of the pad of FIG. 1 taken at line 2—2.

Reference is now made to the drawing and to FIG. 1 and FIG. 2 in particular, wherein a glass lens fining sheet in the form of a circular pad 10 which has been cut to provide a plurality of equally spaced radially aligned slots 11 is depicted. The sheet comprises an abrasive layer 12 which comprises glass fining abrasive granules contained in a microcellular matrix of cured water-insoluble resinous binder material. This layer is adherently bonded to a conformable, flexible backing sheet 13.

A layer 14 of pressure-sensitive adhesive material may also be included on the opposite side of sheet 13 to adhere the pad 10 to the working face of a lens lap. A suitable release liner 15 may also be provided to protect the pressure-sensitive adhesive layer from being contaminated in storage prior to use.

Figure 3:
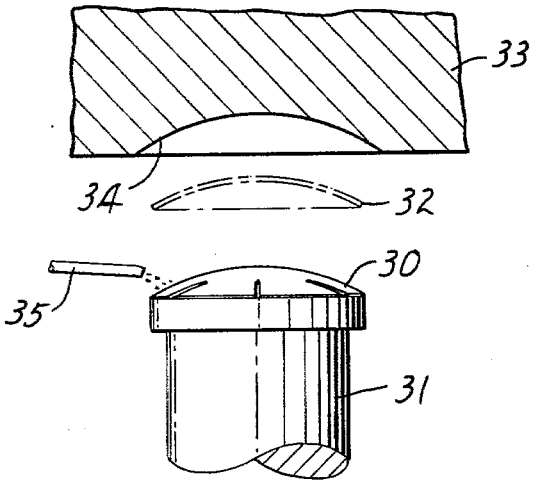
FIG. 3 is an exploded side elevation view partially in cross-section of a lens fining apparatus including a lap having the pad of FIG. 1 mounted on its working face.

In use, the sheet material of the present invention is attached to the working face 30 of a curved lens fining lap 31 as depicted in FIG. 3. The lens 32 is then urged against the lap 31 under conventional pressure against appropriate holding block 33 which has a depression 34 for receiving the lens. It should be noted that some apparatus provide for urging the lap against the lens, this being well known in the lens finishing art. In operation, lap 31 and block 33 are moved with respect to one another with rotational or oscillatory movement while fresh water or other aqueous solution from a suitable source 35 is continuously supplied at a relatively slow rate at the lens/sheet material interface.

The fining abrasive granules and limited amounts of water are maintained at the interface to provide an abrasive slurry which fines the lens surface. The mineral-resin matrix will gradually erode under the effects of load and surface friction, in the presence of an aqueous flow, and will release the abrasive granules over a period of time sufficient to fine the lens.

As fining occurs, the abrasive action causes removal of additional binder material and release of additional abrasive granules, replenishing the supply of abrasive granules at a relatively uniform controlled rate. The loose abrasive granules are carried to the periphery of the interface between the lens and pad and removed with the assistance of the aqueous flow, providing a supply of fresh abrasive granules at the interface during the entire operation.

The form of the fining sheet may be any convenient form presently used for lens grinding or polishing operations such as the disc shape depicted in FIG. 1 or any modification thereof. A disc may be slit or slotted, as shown in FIG. 1, to make it more easily conform to a curved lap or may be provided with other perforations. The pad may also be in other shapes such as rectangular, oval, and the like, depending upon the shape of the lap being employed. The sheet material may be formed into an endless belt by conventional methods by splicing the abutted ends of an elongate strip of the sheet material. The preferred fining pad made in accordance with the present invention is that depicted by FIG. 1 having a plurality of radially aligned equally spaced slots extending from the edge of the pad toward its center.

The fining abrasive granules employed in the present invention have a particle size on the order of 10 to 80 microns and have a Knoop hardness of at least 1000 to provide the necessary degree of abrasion on the surface of the glass being fined. Granules smaller than 10 microns are generally insufficiently abrasive to remove deep scratches in a commercially acceptable amount of time, while granules larger than 90 microns leave deep scratches which generally cannot be removed by conventional polishing operations.

Abrasive materials having adequate hardness may be formed of any conventional abrasive minerals, such as garnet, emery, aluminum oxide, silicon carbide, zirconium oxide and the like. As known from slurry grinding processes, a uniform particle size distribution will provide a uniformly fined (or pitted), scratch-free surface. Since the mechanism of grinding with slurries and with the abrasive sheets of the present invention is primarily based on the rolling action of the abrasive granules, shape ratios close to unity (ratio of the axes of the mineral granules) are preferred. The preferred fining abrasive granules of the present invention are formed of "wheel grade" (or blocky) silicon carbide carefully screened to have a uniform particle size distribution. Particles much larger than the mean should be avoided since they generally will damage or scratch the surface being fined.

The binder which provides the cohesive microcellular matrix which bonds the fining abrasive granule therein and adheres the abrasive layer to the conformable sheet is formed of a water-insoluble resinous material. The cured granule-free, modified binder should have a Knoop hardness value within the range of 15 to 50, preferably 20 to 40, to provide the necessary support to the abrasive granules.

The mineral-resin layer may be described as a rigid microcellular matrix containing minute cells or voids which have average void diameters in a size range which typically does not exceed by more than 50% the size of the abrasive granules, with the average void diameter most typically being approximately the same as or smaller than the average diameter of the abrasive granules. The void fraction of the abrasive layer for useful product according to the present invention have been found to be typically on the order of 0.35 to 0.60. A product having a void fraction less than 0.2 has been found to not fine or grind at a commercially acceptable rate.

A suitable binder composition is provided by urea- or phenol-formaldehyde type thermosetting polymeric materials which are preferably modified by the addition of from about 1% to about 40% (most preferably 3% to about 15%) by weight thermoplastic polymeric modifier to provide increased cohesive strength. Such resins provide good adhesion to the backing substrate and only a minimum adhesion to the surface of the abrasive mineral granules. While unmodified phenol-formaldehyde type resins may be used, some will produce a very brittle mineral-resin matrix which may easily break off when handled.

The thermoplastic polymer modifier may be selected from a variety of polymers, such as polyamides, polyacrylates, polyacrylonitriles, polyvinyl esters, polyvinyl alcohol, copolymers thereof and combinations thereof. The preferred modifier is nitrile rubber latex available from B. F. Goodrich Chemical Company under the trade designation Hycar® 1571.

The modifier materials preferably are added to the coating composition as a solution in a suitable compatible solvent or as a latex or other particulate dispersion in a liquid vehicle such as water.

Such resin coatings may be cured by heating at an appropriate temperature for an appropriate time to remove solvent and affect a complete resin cure, e.g., about 115° C. for approximately 8 hours. Shorter heating times are of course possible at higher temperatures, if tolerated by the backing. The preferred temperature for curing is 100° C. to 130° C.

The weight ratio of fining abrasive granules to binder resin in the abrasive coating should be in the range of about 6:1 to about 2:1, preferably 4:1 to 3:1, if SiC is the abrasive, to obtain the necessary loading of abrasive granules to provide an effective slurry for fining as the binder is worn away. The mineral:resin ratio may be better defined as a volume ratio varying from 0.75:1 to 1.75:1 regardless of the type of abrasive used.

Preparation of the microporous mineral-binder layer requires the preparation of a coated composition which will provide for the formation of minute closed cells or voids which will be retained during coating and curing. Fortunately, most abrasive granules used will by their nature provide such minute cells with one or more cells being associated with each granule and the size of each cell typically not greatly exceeding the size of the granule. Care should be taken to select granules and binder to assure such cell formation and to avoid use of materials which interfere with this effect. In some cases, since adjustment in the coating composition is required to optimize the cell formation effect, the addition of solvents, viscosity aids and fillers may be desirable. Coating techniques should be controlled to prevent binder enrichment at the top surface of the microcellular layer. For example, the viscosity of the mineral-resin coating composition may be adjusted depending on the capability of the particular coating equipment, with compatible solvents, such as water or ethylene glycol monoethyl ether (sold under the trade designation "Ethyl Cellosolve" by Union Carbide Company) or combinations thereof which may be added to obtain the desired coating consistency. The preferred coating composition has a viscosity in excess of 60,000 cps.

The coating weight of the abrasive layer should be at least 450 grams per square meter with a minimum coating thickness of at least 10 mils (dry) to provide sufficient abrasive granules and sufficient thickness to complete a conventional lens fining operation.

Conventional mixing and coating techniques and equipment may be employed to produce the article of the present invention. The preferred mixing equipment is a low speed agitator or kneader, and knife coating is the preferred coating method.

A glass lens fining operation using the abrasive fining pads of the invention is completed in less than 10 minutes, typically in 3 to 6 minutes, if fining a conventional 65 millimeter diameter eyeglass lens having a moderate degree of curvature (6 diopter curve) under a 20 pound load. Under these circumstances, sheet material of the present invention will typically remove at least 0.5 grams of glass, usually about 0.75 to about 1.30 grams of glass.

The conformable, flexible backing sheet may be any suitable material which is compatible with the coating components and maintains its integrity under the curing conditions, including permeable and impermeable materials. However, when impermeable backing materials are used, coating viscosity and drying techniques may require adjustment to prevent the formation of large blisters during drying and loss of cells to such an extent to change the erodability index to an unacceptable level. The preferred backing sheet material is a spun bonded polyester web such as that available from the West Point Pepperell Company of Palatine, Illinois under the trade designation "Lanapress®" No. 00-4219-02 or E. I. duPont Company under the trade designation "Reemay®", but any other web of similar construction may also be used.

The aqueous flow applied in using the fining sheet or pad of the invention is preferably predominately water but may also include other ingredients as typically used in solutions employed in slurry fining or in conventional coated abrasive finishing. Such additives may include water-soluble oils, emulsifiable oils, wetting agents, and the like.

The water flow supply at the interface of the fining pad and lens being fined should be relatively small, on the order of about 1.0 to 50 ml. per minute, preferably 2 to 20 ml. per minute. Too little or too much water will reduce the grinding efficiency. The water flow rate should be adjusted to maximize the amount of glass being cut from the lens surface.

The fining sheet of the invention is attached to the working face of the lap by conventional means. In some instances, it may be desirable to apply a layer of conventional pressure-sensitive adhesive to the back side to facilitate holding the fining sheet to the working face. Useful pressure-sensitive adhesive compositions include those of the rubber-resin type and the acrylate type such as described in the Ulrich patent issued to the assignee of the present invention under U.S. Pat. No. Re. 24,906. The rubber:resin pressure-sensitive adhesives are preferred. When a pressure-sensitive adhesive layer is applied to the fining sheet, it may be desirable to also add a release liner to protect the adhesive surface of the pressure-sensitive adhesive layer from contamination during storage and handling prior to use. Such release liners may be silicone treated paper, nonadherent plastic films or any suitable material known for this purpose.

EXAMPLES

The invention is further illustrated by the following examples:

EXAMPLE 1

| Coating Composition | |
|---|---|
| | Parts by Weight |
| Ingredient | |
| 1. Alkaline catalyzed resole phenol-formaldehyde resin having 53–57% solids, a viscosity of 200–400 cps at 25° C., gel time of 29–36 minutes | |

-continued

| Coating Composition | Parts by Weight |
|---|---|
| at 100° C. and a pH of 9.0–9.4 (available from Ashland Chemical Company under the trade designation "Arofene" ® 72155) | 54 |
| 2. Reactive, low melting polyamide resin having 100% solids, a specific gravity of 0.97, amine value of 275–325, amine equivalent weight of 180, viscosity of 31,000–48,000 cps at 25° C. (available from the General Mills Chemical Company under the trade designation "Versamid" ® 125) | 23 |
| 3. Alkaline catalyzed resole phenol-formaldehyde resin having 75–77% solids a viscosity of 1600–2500 cps at 25° C., a gel time of 50–58 minutes at 100° C., a formaldehyde to phenol ratio of 1.75:1.00, number average molecular weight of 168 and specific gravity of 1.2. | 23 |
| Fining Abrasives Granule | |
| 400 mesh wheel grade silicon carbide having a specific gravity of 3.18 and Knoop hardness of 2480 (average particle size 20 microns) | 275 |

The coating ingredients described above were mixed in the proportions shown to form a homogeneous mixture into which were blended the abrasive granules and about 20 parts by weight ethylene glycol monoethyl ether to form a coatable composition. The resulting (dry) mineral:resin ratio is 4:1 by weight or 1.5:1 by volume.

This composition was then knife coated at a thickness of 0.64 mm on a spun bonded non-woven polyester web weighing approximately 85 grams per square meter and having a thickness of about 10–11 mils (available form the West Point Pepperell Company of Palatine, Ill. under the trade designation "Lanapress®" Style No. 0042-19-02). The coated sheet was then placed in a forced air oven heated at approximately 115° C. and maintained in the oven for about 8 hours. A disc shaped sample of this sheet was cut to the configuration shown in FIG. 1 with a diameter of 76 mm to provide a fining pad.

Fining pads made in accordance with the procedure described in this example were evaluated against standard slurry compositions typical in the lens finishing art and also against conventional coated abrasive sheets. The grinding results of a laboratory evaluation to compare the effective grinding rates of slurries, coated abrasives, and the fining sheet of the present invention are contained in Table 1. The standard slurry containing 12 micron alumina abrasive as is customary in the lens finishing art was evaluated at three concentrations—7.3, 16.0 and 36.4 grams of abrasive per 100 grams of slurry. The standard coated abrasive sheet material contained 15 micron silicon carbide abrasive granules in a 1 to 1 weight ratio with the binder. Each of these was evaluated employing a 65 millimeter rough ground glass lens with moderate curvature and the amount of glass removed after each minute of operation was determined by weighing the lens before and after grinding. A flood of the slurry was continuously applied to the interface of a smooth cast iron lap and the glass lens by a recirculating pump. The standard abrasive sheet material was cut into a pad shape to provide the same abrasive contact area as the pad of the present invention and a flood of water was applied at the interface of this sheet material and the lens being finished. Water was applied to the interface of the lens pad according to the invention and the glass lens being ground at a rate of approximately 2½ cc per minute. In each case, the load between the lap and lens was varied from 10 to 30 pounds as shown in Table 1. The table also shows the amount of glass removed during each time increment and the total amount removed after 4 minutes.

TABLE I

| Load (lbs) | Time (min) | Conventional Slurry (conc. g/100 cc of slurry) 7.3 | 16.0 | 36.4 | Coated Abrasive | Example |
|---|---|---|---|---|---|---|
| 10 | 1 | .150 | .163 | .160 | .022 | .190 |
| | 2 | .130 | .153 | .138 | .002 | .142 |
| | 3 | .063 | .130 | .134 | .001 | .133 |
| | 4 | .027 | .133 | .131 | .001 | .139 |
| | Total | .390 | .579 | .563 | .006 | .604 |
| 20 | 1 | .139 | .213 | .326 | .008 | .330 |
| | 2 | .087 | .122 | .271 | .006 | .232 |
| | 3 | .060 | .099 | .157 | .003 | .193 |
| | 4 | .073 | .083 | .112 | .003 | .110 |
| | Total | .359 | .517 | .866 | .020 | .865 |
| 30 | 1 | .108 | .192 | .286 | .012 | .325 |
| | 2 | .072 | .085 | .187 | .008 | .271 |
| | 3 | .031 | .076 | .131 | .003 | .348 |
| | 4 | .009 | .057 | .096 | .004 | .295 |
| | Total | .220 | .410 | .700 | .027 | 1.239 |

As can be seen, the pad of the invention performed as well as or better than conventional slurry under load conditions of 10 to 30 lbs. Conventional coated abrasives were proven totally unacceptable.

The surface quality of the processed glass lenses was determined by measuring the roughness and surface profile data on a Bendix Proficorder. The recorded CLA-values (Center-Line-Average)—also referred to as Arithmetrical Average (AA) Data—describe the standard deviation of peak and valley from the mean. The average Net Peak Height (NPH) describes the average peak-valley height The "Max NPH" describes the isolated deep scratches.

A summary of the profile data for finished lenses during various stages of the finishing includes (1) the rough generated lens surfaces before fining, (2) the resultant lens surface after being fined either with a fining pad according to this invention as prepared in Example 1 or with a commercial 12 micron aluminum oxide slurry and (3) the finished lenses after having been polished with conventional 1–3 micron cerium oxide slurries, is given in Table 2.

TABLE 2

| Evaluation of Glass Lens Surfaces (microns) | | | |
|---|---|---|---|
| /(1) | Generated: | CLA | 5.0 |
| | (Before fining) | AV. Net Peak H. | 10.0 |
| | | Max. Net Peak H. | 25.0 |
| (2) | After Fining: | Ex.1 | Slurry |
| | CLA | 1.5 | 1.4 |
| | Av. NPH | 5.0 | 4.5 |
| | Max. NPH | 7.5 | 7.5 |
| (3) | After Polishing | Ex.1 | Slurry |
| | CLA. | 0.10 | 0.10 |
| | Av. NPH | 0.17 | 0.16 |
| | Max. NPH | 0.22 | 0.23 |

The accuracy of the optical curvature of the finished lenses processed by each method was determined by measuring the diopter strength (focal length) and optical axis on a lensometer commonly used in optical laboratories. The lenses processed by both methods exhibited the desired optical accuracy.

EXAMPLE 2

| Coating Composition | Parts by Weight (wet) |
|---|---|
| Ingredient | |
| 1. Phenol-formaldehyde resin having 53–57% solids, trade designation "Arofene" ® 72155 (as described in Example 1) | 50 |
| 2. Phenol-formaldehyde resin having 75–77% solids (as described in Example 1) | 41 |
| 3. A nitrile rubber latex having 42–44% solids available from B.F. Goodrich Chemical Corp. under the trade designation "Hycar" ® 1571 | 9 |
| Fining Abrasive Granule | |
| 400 mesh, wheel grade silicon carbide (as described in Example 1) | 218 |

The coating ingredients described above were mixed in the proportions shown to form a homogeneous mixture into which were blended the abrasive granules and about 20 parts by weight water to form a coatable composition. The resulting (dry) mineral:resin ratio is 3.5:1 by weight or 1.4:1 by volume. The composition was knife-coated on the non-woven web, cured and converted into fining pads as described in Example 1. The grinding results are summarized in Table 3.

EXAMPLE 3

| Coating Composition | Parts by Weight (wet) |
|---|---|
| Ingredient | |
| 1. Phenol-formaldehyde resin having 53–57% solids, trade designation "Arofene" ® 72155 (as described in Example 1) | 37.5 |
| 2. Phenol-formaldehyde resin having 75–77% solids (as described in Example 1) | 58 |
| 3. An acrylic latex having 48–52% solids available from B.F. Goodrich Chemical Corp. under the trade designation "Hycar" ® 2679 | 4.5 |
| Fining Abrasive Granule | |
| 400 mesh, wheel grade silicon carbide (as described in Example 1) | 270 |

The coating ingredients and the mineral were mixed and the viscosity adjusted with water as described in Example 2. The resulting (dry) mineral:resin ratio is 4:1 by weight or 1.6:1 by volume.

The composition was knife-coated on an impermeable non-woven web, cured and converted into fining pads as described in Example 1. The saturated non-woven web was the spun bonded polyester web described in Example 1 saturated with 3.7 mg per $cm^2$ of a 1:1 mixture on a solids basis of the 75–77% solids phenol-formaldehyde resin and the acrylic latex described above.

The grinding results are summarized in Table 3.

EXAMPLE 4

| Coating Composition | Parts by Weight (wet) |
|---|---|
| Ingredient | |
| 1. Phenol-formaldehyde resin having 53–57% solids, trade designation "Arofene" ® 72155 (as described in Example 1) | 26 |
| 2. Phenol-formaldehyde resin having 75–77% solids (as described in Example 1) | 41 |
| 3. A nitrile rubber latex having 42–44% solids, trade designation "Hycar ®" 1571 (as described in Example 2) | 11 |
| 4. An aqueous polyvinyl alcohol solution 5% solids, made from a polyvinyl alcohol powder available from E. I. duPont Corp. under the trade designation "Elvano ®", fully hydrolyzed | 22 |
| Fining Abrasive Granule | |
| 400 mesh, wheel-grade silicon carbide (as described in Example 1) | 204 |

The coating ingredients and the mineral were mixed and subsequently coated as described in the previous Examples 1–3 to provide a mineral:resin weight ratio of 4:1 (volume ratio of 1.56:1).

The fining pads made therefrom were tested and results are summarized in Table 3.

EXAMPLE 5

| Coating Composition | Parts by Weight (wet) |
|---|---|
| Ingredient | |
| 1. Phenol-formaldehyde resin having 53–57% solids, trade designation "Arofene" ® 72155 (as described in Example 1) | 50 |
| 2. Phenol-formaldehyde resin having 75–77% solids (as described in Example 1) | 41.5 |
| 3. A nitrile rubber latex having 42–44% solids, trade designation "Hycar" ® 1571 (as described in Example 2) | 8.5 |
| Fining Abrasive Granule | |
| 400 mesh, wheel grade aluminum oxide having a specific density of 3.95 and a Knoop hardness of about 2100 | 269 |

The coating ingredients and the mineral were mixed and subsequently coated as described in the previous Examples 1–4. The (dry) mineral:resin ratio is 4.3:1 (1.37:1 volume ratio) which is comparable to a 3.5:1 ratio of the less dense silicon carbide mineral.

The fining pads made therefrom were tested and results are summarized in Table 3.

EXAMPLE 6

| | Parts by wt. (wet) |
|---|---|
| Ingredient | |
| 1. Urea-formaldehyde resin having 63– | |

-continued

| | Parts by wt. (wet) |
|---|---|
| 66% solids, a pH of 7.6 and a specific density of 1.296 available from the Borden Chemical Co. under the trade designation "Durite®" AL-8401 | 86 |
| 2. Nitrile rubber latex having 42–44% solids available under the trade designation "Hycar®" 1571 | 14 |
| 3. 25% aqueous solution of ammonium chloride ($NH_4Cl$) as a catalyst for the urea-formaldehyde resin | 8 |
| 4. Fining abrasive granules, 400 mesh, wheel grade silicon carbide (as described in Example 1) | 186 |

The coating ingredients and the abrasive granules were mixed and subsequently coated as described in the previous Examples 1–5.

The fining pad made therefrom was tested and the results are summarized in Table 3.

TABLE 3

Summary of Grinding Tests Grams of Glass
Machine: Coburn #506 cylinder lens polisher
Conditions: 20 lbs/4 minutes

| Example | Mineral | Mineral: Resin Weight Ratio | Resin Type | Stock Removed (g) |
|---|---|---|---|---|
| 1 | SiC | 4:1 | Phenolic/Polyamide | .865 |
| 2 | SiC | 3.5:1 | Phenolic/Rubber | 1.194 |
| 3 | SiC | 4:1 | Phenolic/Acrylic | 1.392 |
| 4 | SiC | 4:1 | Phenolic/Rubber/PVA | 1.036 |
| 5 | $Al_2O_3$ | 4.3:1 | Phenolic/Rubber | 0.935 |
| 6 | SiC | 3:1 | Ureaformaldehyde/ Rubber | 0.864 |
| Control Slurry | $Al_2O_3$ | — | — | .866 |
| Control Coated Abrasive | SiC | 1:1 | Phenolic | .020 |

EXAMPLES 7–13 and CONTROL A–D

Examples 7–13 and Control Examples A–D were prepared and evaluated according to the methods described in Examples 1–6. The specific ingredients forming these examples were as follows:

Identification of Ingredients

"Phenolic I" is obtained from an alkaline catalyzed resole phenol-formaldehyde resin having 75–77% solids, a viscosity of 1600–2500 cps at 25° C., a gel time of 50–58 minutes at 100° C., a formaldehyde to phenol ratio of 1.75:1.00, number average molecular weight of 168 and specific gravity of 1.2.

"Phenolic II" is obtained from an alkaline catalyzed resole phenol-formaldehyde resin having 53–57% solids, a viscosity of 200–400 cps at 25° C., gel time of 29–36 minutes at 100° C. and a pH of 9.0–9.4 (available from Ashland Chemical Company under the trade designation "Arofene®" 72155).

"Nitrile rubber" is obtained from a nitrile rubber latex having 42–44% solids and is available under the trade designation "Hycar®" 1571.

"Polyamide" is obtained from a reactive, low melting polyamide resin having 100% solids, a specific gravity of 0.97, amine value of 275–325, amine equivalent weight of 180, viscosity of 31,000–48,000 cps at 25° C. (available from the General Mills Chemical Company under the trade designation "Versamid®" 125).

Specific compositions (in parts by weight dry)

| | | Parts |
|---|---|---|
| Example 7 | | |
| Binder: | Phenolic I | 64 |
| | Phenolic II | 30 |
| | Nitrile rubber | 6 |
| Abrasive: | 400 mesh SiC | 400 |
| Example 8 | | |
| Binder: | Phenolic I | 50 |
| | Phenolic II | 44 |
| | Nitrile rubber | 6 |
| Abrasive: | 400 mesh alumina:zirconia | 500 |
| Example 9 | | |
| Binder: | Phenolic I | 50 |
| | Phenolic II | 44 |
| | Nitrile rubber | 6 |
| Abrasive: | 400 mesh $Al_2O_3$ | 400 |
| Example 10 | | |
| Binder: | Phenolic I | 50 |
| | Phenolic II | 44 |
| | Nitrile rubber | 6 |
| Abrasive: | 400 mesh $Al_2O_3$ | 450 |
| Example 11 | | |
| Binder: | Phenolic I | 35 |
| | Phenolic II | 32.5 |
| | Polyamide | 32.5 |
| Abrasive: | 400 mesh SiC | 400 |
| Example 12 | | |
| Binder: | Phenolic I | 56.5 |
| | PhenolicII | 11 |
| | Polyamide | 32.5 |
| Abrasive: | 400 mesh SiC | 400 |
| Example 13 | | |
| Binder: | Phenolic I | 67 |
| | Phenolic II | 32 |
| | Nitrile rubber | 1 |
| Abrasive: | 400 mesh SiC | 400 |
| Control A | | |
| Binder: | Phenolic I | 64 |
| | Phenolic II | 30 |
| | Nitrile rubber | 6 |
| Abrasive: | 400 mesh SiC | 250 |
| Control B | | 50 |
| Binder: | Phenolic I | 50 |
| | Phenolic II | 44 |
| | Nitrile rubber | 6 |
| Abrasive: | 400 mesh alumina:zirconia | 350 |
| Control C | | |
| Binder: | Phenolic I | 50 |
| | Nitrile rubber | 50 |
| Abrasive: | 400 mesh SiC | 400 |
| Control D | | |
| Binder: | Phenolic I | 100 |
| Abrasive: | 400 mesh SiC | 150 |

In Table 4, both the Erodability Factor and the Glass Stock Removal are reported. The method of obtaining the Erodability Factor is described above while the method of obtaining the Glass Stock Removal is the same as in Example 1 when a 20 lb. load is used.

TABLE 4

| EX. NO. | MINERAL | ERODABILITY FACTOR (cc) | GLASS STOCK REMOVAL GRAMS/4 MINUTES |
|---|---|---|---|
| 1 | SiC | .189 | .865 |
| 2 | SiC | .204 | 1.194 |
| 3 | SiC | .220 | 1.392 |
| 4 | SiC | .196 | 1.036 |
| 5 | $Al_2O_3$ | .260 | .935 |
| 6 | SiC | .177 | .864 |
| 7 | SiC | .251 | 1.160 |
| 8 | Alumina: Zirconia | .208 | 1.100 |
| 9 | $Al_2O_3$ | .192 | .908 |

TABLE 4-continued

| EX. NO. | MINERAL | ERODABILITY FACTOR (cc) | GLASS STOCK REMOVAL GRAMS/4 MINUTES |
|---|---|---|---|
| 10 | $Al_2O_3$ | .214 | 1.140 |
| 11 | SiC | .167 | .940 |
| 12 | SiC | .252 | .997 |
| 13 | SiC | .167 | .940 |
| A | SiC | .115 | .407 |
| B | Alumina: Zirconia | .090 | .376 |
| C | SiC | .471 | .173 |
| D | SiC | .006 | .020 |

What is claimed is:

1. A fining sheet being capable of generating a fining slurry when subjected to an aqueous flow, pressure, and movement against vitreous stock being fined, comprising a flexible, conformable backing sheet covered on one side thereof with a microcellular layer having a weight of at least 450 g. per $m^2$ and a thickness of at least 10 mils said layer being comprised of (a) a cured modified resinous binder material having a Knoop hardness value in the range of 15 to 50 and being selected from a group consisting of urea formaldehyde and phenol formaldehyde modified with about 1% to about 40% by weight of a thermoplastic polymeric modifier selected from the group consisting of polyamide, polyacrylate, polyacrylonitrile, polyvinyl ester, polyvinyl alcohol, and copolymers comprising said thermoplastic polymeric modifiers and combinations thereof; and (b) abrasive fining granules having a Knoop hardness of at least about 1000 and an average particle size of about 15 to 60 microns to provide a volume ratio of abrasive granules to binder in the range of about 0.75:1 to 1.75:1.

2. The fining sheet in accordance with claim 1 in the form of a circular disc having radially aligned slots commencing at its edge and extending toward but not reaching the center of said disc.

3. The fining sheet in accordance with claim 1 in the form of an endless belt.

4. The fining sheet in accordance with claim 1 including a pressure-sensitive adhesive on the surface opposite the abrasive surface of said flexible backing sheet.

5. A method of making a fining sheet comprising:

(1) mixing a curable resin composition containing from about 99% to about 60% by weight of a thermosetting material selected from urea-formaldehyde and phenol-formaldehyde with from about 1% to about 40% thermoplastic polymeric modifier in a suitable liquid vehicle, with abrasive fining abrasive granules having an average particle size of 15 to 60 microns to provide a volume ratio of abrasive granules to resin on the order of 0.75:1 to 1.75:1 and to form a cellular viscous mass;

(2) coating the viscous mass on a conformable, flexible sheet to provide a substantially uniform coating thickness of at least 10 mils when dried;

(3) drying and curing the coating at a temperature of less than about 140° C., to form a rigid microcellular abrasive granule-resin matrix.

6. A method of fining vitreous surfaces comprising:

(1) applying a fining sheet according to claim 1 to a vitreous surface to be fined; and (2) moving said fining sheet with respect to said vitreous surface in forced contact with rotational and/or oscillatory movement while maintaining said abrasive fining sheet in an aqueous environment which is continuously being replenished for a time sufficient to separate abrasive particles from said sheet at a rate and concentration to produce and maintain a slurry of abrasive particles capable of fining said vitreous surface.

* * * * *

UNITED STATES PATENT AND TRADEMARK OFFICE

CERTIFICATE OF CORRECTION

PATENT NO. : 4,255,164

DATED : March 10, 1981

INVENTOR(S) : Hilbert C. Butzke and Dennis W. Harry

It is certified that error appears in the above-identified patent and that said Letters Patent are hereby corrected as shown below:

In the Specification:

Page 29, lines 2-4 (Col. 13, lines 24-25) "Glass Machine:" should read --Glass Removed After Fining Cycle. Machine:--

Page 32, line 16 (Col. 14, line 39) "Control B 50" should read --Control B--.

Signed and Sealed this

Ninth Day of June 1981

[SEAL]

Attest:

RENE D. TEGTMEYER

Attesting Officer

Acting Commissioner of Patents and Trademarks